US009926671B2

(12) United States Patent
Yun

(10) Patent No.: US 9,926,671 B2
(45) Date of Patent: Mar. 27, 2018

(54) METHOD FOR REPAIRING PAVED ROAD

(71) Applicant: KANGWON NATIONAL UNIVERSITY UNIVERSITY-INDUSTRY COOPERATION FOUNDATION, Gangwon-do (KR)

(72) Inventor: Kyong Ku Yun, Seoul (KR)

(73) Assignee: KANGWON NATIONAL UNIVERSITY UNIVERSITY—INDUSTRY COOPERATION FOUNDATION, Gangwon-do (KR)

( * ) Notice: Subject to any disclaimer, the term of this patent is extended or adjusted under 35 U.S.C. 154(b) by 0 days.

(21) Appl. No.: 15/110,480

(22) PCT Filed: Jan. 9, 2015

(86) PCT No.: PCT/KR2015/000213
§ 371 (c)(1),
(2) Date: Jul. 8, 2016

(87) PCT Pub. No.: WO2015/105362
PCT Pub. Date: Jul. 16, 2015

(65) Prior Publication Data

US 2016/0376752 A1 Dec. 29, 2016

(30) Foreign Application Priority Data

Jan. 10, 2014 (KR) ..... 10-2014-0003348
Feb. 6, 2014 (KR) ..... 10-2014-0013388

(51) Int. Cl.
*E01C 7/14* (2006.01)
*E01C 11/00* (2006.01)
*E01C 23/06* (2006.01)

(52) U.S. Cl.
CPC ..... *E01C 7/147* (2013.01); *E01C 11/005* (2013.01); *E01C 23/06* (2013.01)

(58) Field of Classification Search
USPC ..... 404/75, 78
See application file for complete search history.

(56) References Cited

U.S. PATENT DOCUMENTS 3,062,669 A * 11/1962 Dilnot ..... C04B 28/18 106/672
3,732,791 A * 5/1973 Hohwiller ..... C04B 16/08 404/31

(Continued)

FOREIGN PATENT DOCUMENTS

JP 2008-002220 9/2010
KR 10-2000-0052017 6/2000

(Continued)

OTHER PUBLICATIONS

International Search Report dated Apr. 9, 2015 for PCT/KR2015/000213.

*Primary Examiner* — Thomas B Will
*Assistant Examiner* — Katherine J Chu

(57) ABSTRACT

A method for repairing a paved road comprises forming a repair section by removing a damaged part of a concrete pavement or an asphalt pavement, and repairing by shooting in the repair section rapid-set blended concrete wherein concrete having improved fluidity as a result of mixing normal concrete having compressive strength of 21-30 MPa with bubbles of 20-40% of the volume of the normal concrete is mixed with a high-early-strength mixture material; and high-performance rapid-set blended concrete wherein a high-early-strength mixture material and a high-durability mixture material are mixed together.

19 Claims, 7 Drawing Sheets

(56) References Cited

U.S. PATENT DOCUMENTS 3,870,422 A * 3/1975 Medico, Jr. ..... E01C 3/00 404/17
3,915,582 A * 10/1975 Clarke ..... B28D 1/265 404/34
4,630,963 A * 12/1986 Wyman ..... C04B 26/16 404/75
5,354,145 A * 10/1994 Sterner ..... E01C 23/06 404/107
5,380,123 A * 1/1995 Ryynanen ..... E01C 3/00 14/24
5,771,557 A * 6/1998 Contrasto ..... E01C 7/147 264/36.2
6,821,052 B2 * 11/2004 Zurn ..... E01C 19/006 404/101
7,735,274 B2 * 6/2010 Constantz ..... C04B 14/26 106/738
2003/0026652 A1 * 2/2003 Broadway, III ..... E01C 7/187 404/75
2004/0146351 A1 * 7/2004 McIntosh ..... C08L 95/00 404/75
2007/0116517 A1 * 5/2007 Sapozhnikov ..... E01C 3/003 404/17
2009/0087262 A1 * 4/2009 Tucker ..... E01C 23/06 404/75
2010/0119851 A1 * 5/2010 Giessler-Blank ..... C04B 24/42 428/447
2011/0217475 A1 * 9/2011 Bonin ..... C04B 24/2623 427/427
2011/0293954 A1 * 12/2011 Kao ..... C04B 26/26 428/451
2013/0121763 A1 * 5/2013 Phillips ..... E01C 23/06 404/25
2015/0251952 A1 * 9/2015 Byrd ..... C04B 28/04 106/672
2016/0121486 A1 * 5/2016 Lipinski ..... B05B 13/005 427/427.3

FOREIGN PATENT DOCUMENTS

KR 10-2000-0052017 8/2000
KR 10-2003-0071143 9/2003
KR 10-0621695 9/2006
KR 10-2007-0035377 3/2007
KR 10-0875211 12/2008
KR 10-2009-0043631 5/2009
KR 10-0982469 9/2010
KR 10-1215784 12/2012

* cited by examiner

METHOD FOR REPAIRING PAVED ROAD

This application claims the priority of Korean Patent Application Nos. 10-2014-003348, and 10-2014-0013388, filed on Jan. 10, 2014, and Feb. 6, 2014 in the KIPO (Korean Intellectual Property Office), the disclosure of which is incorporated herein entirely by reference. Further, this application is the National Stage application of International Application No. PCT/KR2015/000213, filed Jan. 9, 2015, which designates the United States and was published in Korean. Each of these applications is hereby incorporated by reference in their entirety into the present application.

TECHNICAL FIELD

The present disclosure relates to a method for repairing a paved road, and more particularly, to a method for repairing a paved road, which removes a damaged part of a concrete pavement or an asphalt pavement to form a repair section, then mixes 20 to 40% of bubbles, based on the volume of a normal concrete, with a normal concrete having a compressive strength of 21 to 30 MPa to increase fluidity, and shoots a rapid-set blended concrete mixed with a high-early-strength mixture material and a high-performance rapid-set blended concrete mixed with a high-early-strength mixture material and a durable mixture material to the repair section for repairing.

BACKGROUND ART

Generally, a paved road is classified into a concrete pavement and an asphalt pavement. The concrete pavement is classified into a joint concrete pavement (JCP) and a continuously reinforced concrete pavement (CRCP). The joint concrete pavement is a kind of concrete pavement constructed at most roads of this country, and joints are formed with a predetermined width and depth at the concrete pavement to extend or shrink according to the change of temperature of the concrete pavement and thus prevent the concrete pavement from being damaged. However, the joint concrete pavement may suffer from complex damages such as joint damage, spalling, cracks, steps, surface scaling or the like due to environmental or structural factors.

The repairing method for the concrete pavement is generally classified into a preventive management method for preventing a damage and a repairing method for repairing a damage. The repairing method for repairing a damage includes a partial section repair, a full depth repair, slab jacking, surface grinding, overlay or the like.

The full depth repair is applied when a serious damage occurs at a pavement slab having a large area, when a plurality of cracks are generated complicatedly, or when a surface defect is serious. In the full depth repair, concrete is detached to a depth of the slab before being caved, and then new concrete is paved.

As domestic highway concrete pavements are aged, the pavements become deteriorated and thus are temporarily or emergently repaired. In particular, in a joint concrete pavement, traverse cracks generating over the entire width of a slab, corner cracks generating at edges, severe spalling at a joint, or complicated damage deteriorates the ride comfort and causes serious car accidents. For this reason, the full depth repair is inevitable. However, in case of the full depth repair, since concrete should be cured for a sufficiently time, traffic should be blocked at a highway, which may cause various inefficient factors such as traffic congestion, danger of accident and civil complaints.

In addition, the asphalt pavement means a pavement having an asphalt mixture prepared by combining aggregate with bituminous material as a surface layer, and the asphalt pavement includes a black base, a sub-base, a road bed or the like.

After analyzing 119 damage areas of highways where the asphalt pavement is constructed, as a result of field studies, it has been found that pot holes are most frequent, followed by cracks and plastic deformation, and such damage factors are caused by various internal factors and external factors such as inferior aggregate, deficient harden management, water penetration, overload or the like and are not easily controlled.

In order to solve the problems of the asphalt pavement, there has been developed a construction technique in which the asphalt pavement layer is partially cut and is overlaid with cement concrete, which however is not broadly applied due to a traffic opening time problem, heavy concrete paver equipment, construction costs, cracks generated during the construction work or the like.

RELATED LITERATURES

Korean Unexamined Patent Publication No. 10-2009-0043631

Korean Unexamined Patent Publication No. 10-2003-0071143

Korean Patent Registration No. 10-0621695

DISCLOSURE OF THE INVENTION

Technical Problem

The present disclosure is designed to solve the above problems, and the present disclosure is directed to providing a method for repairing a paved road, which may remove a damaged part of a concrete pavement or an asphalt pavement to form a repair section, then mix 20 to 40% of bubbles, based on the volume of a normal concrete, with a normal concrete having a compressive strength of 21 to 30 MPa to increase fluidity, and shoot a rapid-set blended concrete mixed with a high-early-strength mixture material and a high-performance rapid-set blended concrete mixed with a high-early-strength mixture material and a durable mixture material to the repair section for repairing.

The present disclosure is also directed to providing a method for repairing a paved road, which may ensure easy transportation and installation and reduce construction costs due to pavement equipment with a smaller and lighter design, by applying a shotcrete method, which does not need hardening of the asphalt pavement.

Technical Solution

In one general aspect, the present disclosure provides a method for repairing a paved road, comprising:

forming a repair section by marking and cutting a repair boundary to accommodate a damaged part of a paved road;

producing a normal concrete having a compressive strength of 21 to 30 MPa by mixing water, cement and aggregate at a predetermined ratio and transporting the normal concrete to a construction site;

putting 20 to 40% of bubbles, based on the volume of the normal concrete, together with a high-early-strength mixture material into the normal concrete and then mixing the same by means of a mixing unit to form a rapid-set blended concrete;

shooting the rapid-set blended concrete to the repair section by means of a shooting guide member to form a lower layer portion of the paved road while dissipating bubbles included in the rapid-set blended concrete;

putting 20 to 40% of bubbles, based on the volume of the normal concrete, together with a high-early-strength mixture material and a durable mixture material into the normal concrete and then mixing the same by means of the mixing unit to form a high-performance rapid-set blended concrete;

shooting the high-performance rapid-set blended concrete to a top surface of the lower layer portion by means of the shooting guide member to form an upper layer portion of the paved road while dissipating bubbles included in the high-performance rapid-set blended concrete; and surface-finishing and curing the paved road so that a top surface of the upper layer portion keeps horizontal to a top surface of the paved road.

In another aspect, the present disclosure also provides a method for repairing a paved road, comprising:

forming a repair section by marking and cutting a repair boundary to accommodate a damaged part of a paved road;

producing a normal concrete having a compressive strength of 21 to 30 MPa by mixing water, cement and aggregate at a predetermined ratio and transporting the normal concrete to a construction site;

putting 20 to 40% of bubbles, based on the volume of the normal concrete, together with a high-early-strength mixture material and a durable mixture material into the normal concrete and then mixing the same by means of a mixing unit to form a high-performance rapid-set blended concrete;

shooting the high-performance rapid-set blended concrete to the repair section by means of a shooting guide member to form a paved road while dissipating bubbles included in the high-performance rapid-set blended concrete; and surface-finishing and curing the paved road so that a top surface of the upper layer portion keeps horizontal to a top surface of the paved road.

Advantageous Effects

According to the present disclosure, after a damaged part of a concrete pavement or an asphalt pavement is removed to form a repair section, in a state where 20 to 40% of bubbles, based on the volume of the normal concrete, is mixed with a normal concrete having a compressive strength of 21 to 30 MPa to increase fluidity, a rapid-set blended concrete mixed with a high-early-strength mixture material and a high-performance rapid-set blended concrete mixed with a high-early-strength mixture material and a durable mixture material are shot to the repair section for repairing, which may allow early opening of the repaired region to ensure easy construction and also allow easy maintenance by reducing construction costs and ensuring high strength and high durability.

In addition, according to the present disclosure, by applying a shotcrete method which does not need hardening of the asphalt pavement, pavement equipment may have a smaller and lighter design, which ensures easy transportation and installation, and also construction costs may be reduced to ensure improved economic feasibility.

| [Detailed Description of Main Elements] | |
|---|---|
| 10: batcher plant | 20: paved road |
| 30: reinforcing member | 40: concrete mixer truck |
| 50: pump car | 60: mixing unit |
| 70: shooting guide member | |

MODE FOR CARRYING OUT THE INVENTION

Figure 1:
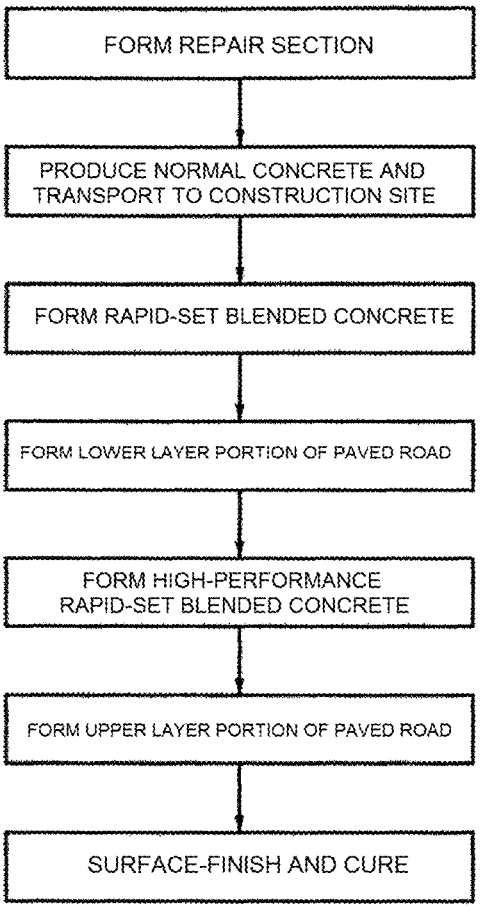
FIG. 1 is a flowchart of an embodiment of the present disclosure.

Hereinafter, the present disclosure will be described in detail with reference to accompanying drawings. FIG. 1 is a flowchart of an embodiment of the present disclosure.

A method for repairing a paved road according to the present disclosure includes:

forming a repair section 20' by marking and cutting a repair boundary to accommodate a damaged part of a paved road 20;

producing a normal concrete having a compressive strength of 21 to 30 MPa by mixing water, cement and aggregate at a predetermined ratio and transporting the normal concrete to a construction site;

putting 20 to 40% of bubbles, based on the volume of the normal concrete, together with a high-early-strength mixture material into the normal concrete and then mixing the same by means of a mixing unit 60 to form a rapid-set blended concrete;

shooting the rapid-set blended concrete to the repair section 20' by means of a shooting guide member 70 to form a lower layer portion 21 of the paved road 20 while dissipating bubbles included in the rapid-set blended concrete;

putting 20 to 40% of bubbles, based on the volume of the normal concrete, together with a high-early-strength mixture material and a durable mixture material into the normal concrete and then mixing the same by means of the mixing unit 60 to form a high-performance rapid-set blended concrete;

shooting the high-performance rapid-set blended concrete to a top surface of the lower layer portion 21 by means of the shooting guide member 70 to form an upper layer portion 22 of the paved road 20 while dissipating bubbles included in the high-performance rapid-set blended concrete; and surface-finishing and curing the paved road so that a top surface of the upper layer portion 22 keeps horizontal to a top surface of the paved road 20.

Figure 2:
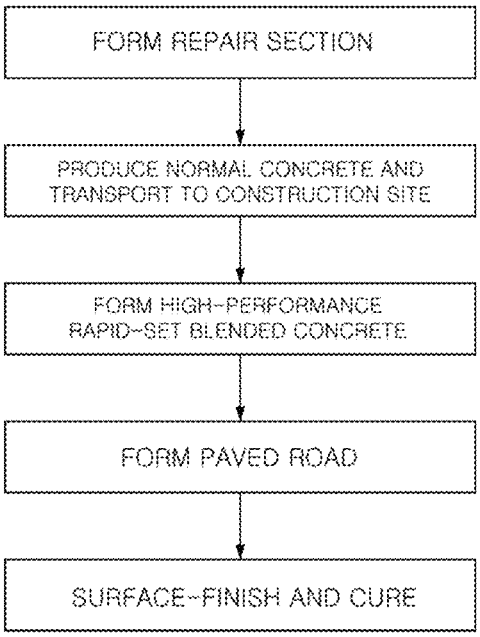
FIG. 2 is a flowchart of another embodiment of the present disclosure.

In addition, as shown in FIG. 2, the method for repairing a paved road according to the present disclosure may include:

forming a repair section 20' by marking and cutting a repair boundary to accommodate a damaged part of a paved road 20;

producing a normal concrete having a compressive strength of 21 to 30 MPa by mixing water, cement and aggregate at a predetermined ratio and transporting the normal concrete to a construction site;

putting 20 to 40% of bubbles, based on the volume of the normal concrete, together with a high-early-strength mixture material and a durable mixture material into the normal concrete and then mixing the same by means of the mixing unit 60 to form a high-performance rapid-set blended concrete;

shooting the high-performance rapid-set blended concrete to the repair section 20' by means of the shooting guide member 70 to form the paved road 20 while dissipating bubbles included in the high-performance rapid-set blended concrete; and surface-finishing and curing the paved road 20 so that a top surface of the upper layer portion keeps horizontal to a top surface of the paved road.

A process for repairing the paved road according to the present disclosure, configured as above, will be described.

First, a repair section 20' is formed by marking and cutting a repair boundary to accommodate a damaged part of a paved road 20. Here, if the paved road 20 is a concrete-paved road 20*a*, the marked repair boundary is cut using a cutting member such as a diamond saw or a cutter, and then the cut slab is broken into a plurality of lumps and then removed to form a repair section 20'. At this time, the cut repair boundary should be carefully handled not to damage a slab or a sub-base. However, if a sub-base is inevitably damaged, the damaged sub-base is sufficiently hardened till completely restoring, and a separation film is installed thereto using vinyl.

Here, in order to enhance a load transmission effect of the repair boundary, a hole is formed in the concrete-paved road 20*a* by means of a drill, and then a reinforcing member 30 such as a dowel bar and a tie bar is installed thereto. At this time, the dowel bar is placed at an existing joint and a new joint installation portion, and the tie bar is installed at a vertical joint and an adjacent paved road.

The hole is formed to have a diameter greater than the reinforcing member 30 by 1.5 mm. After an epoxy resin is injected into the hole, the reinforcing member 30 is rotated and coupled to be settled. If the epoxy resin is excessively applied to protrude at the repair boundary of the concrete-paved road 20*a*, the protruding epoxy resin is swept using a brush and removed. Also, an epoxy resin or dust adhered to an iron bar should be removed.

The repair boundary may be formed at an existing joint connection side. If the repair boundary does not have an existing joint connection side, the repair boundary is cut into a partial depth with a maximum depth of 50 mm. Here, the repair boundary is cut perpendicular to the existing connection side at every edge so that the repair section 20' has a rectangular pattern. Also, the repair boundary is cut at a position spaced apart from the existing joint or crack by at least 0.6 m, and then a separation film such as vinyl is installed at the repair section 20' to separate the repair boundary.

In addition, if the paved road 20 is an asphalt-paved road 20*b*, the marked repair boundary is cut and removed to a depth of 130 to 200 mm using a cutting member such as a milling machine to form a cut surface, and the cut surface is surface-treated. At this time, air blasting is performed to form a repair section 20' from which residues are completely removed.

Figure 3:
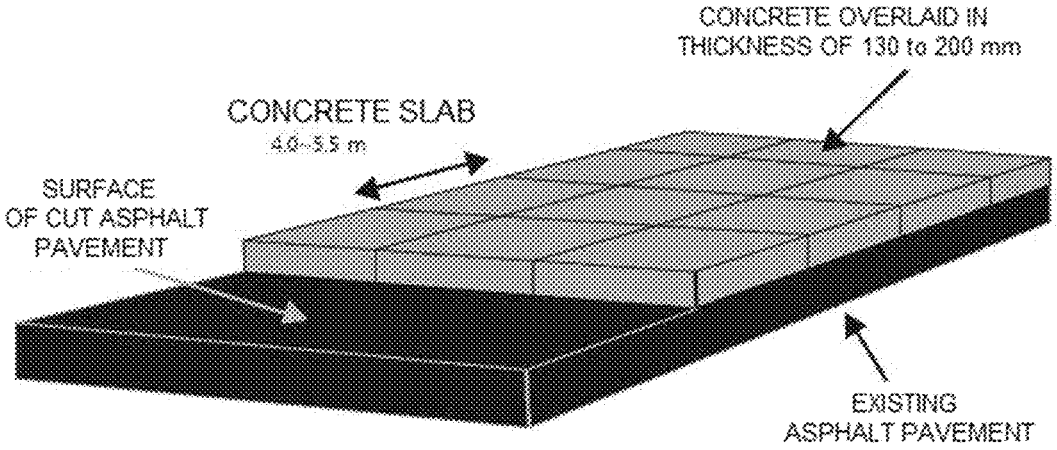
FIGS. 3 and 4 are diagrams for illustrating a method for repairing an asphalt-paved road according to the present disclosure.
Figure 4:
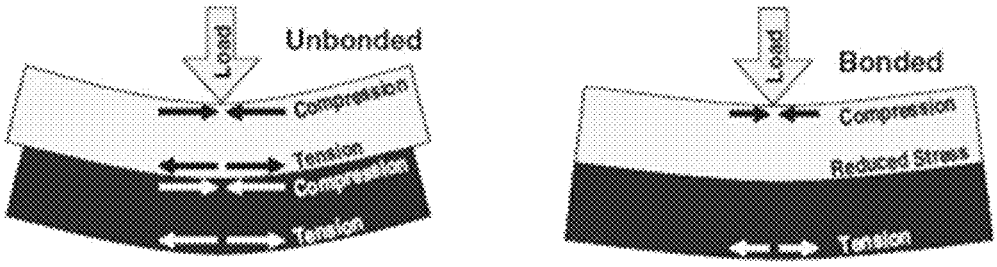
Figure 5:
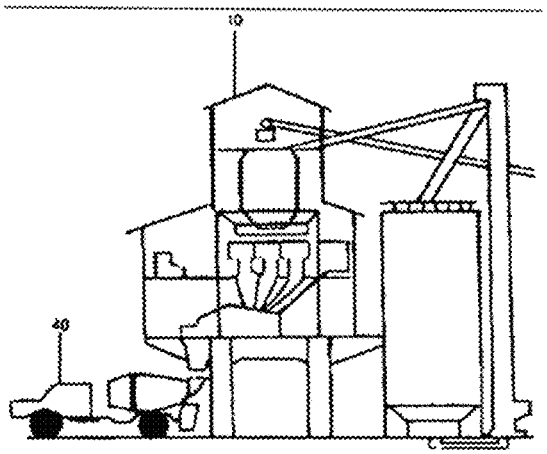
FIG. 5 is a diagram showing that a normal concrete is formed according to the present disclosure.

Here, as shown in FIGS. 3 and 4, if concretes deposited to the asphalt-paved road 20*b* and the repair section 20' are separated and move, a great stress is generated at the concrete deposited to the repair section 20'. However, if the concrete deposited to the repair section 20' and the paved road 20 made of asphalt are entirely adhered and move integrally, a neutral axis moves downwards so that a small stress is generated at the concrete.

Figure 7:
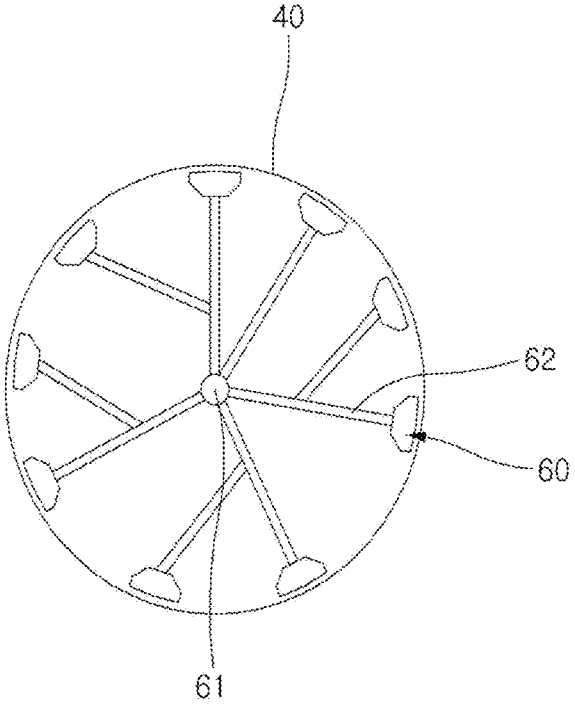

If the repair section 20' is formed at the concrete-paved road 20*a* or the asphalt-paved road 20*b* serving as the paved road 20, as shown in FIG. 7, water, cement, aggregate or the like respectively supplied from a batcher plant 10 are mixed and blended at a predetermined ratio to produce a normal concrete having a compressive strength of 21 to 30 MPa, and a slump of the normal concrete is maintained in the range of 60 to 80 mm so that the normal concrete may be easily transported to a construction site by means of a concrete mixer truck 40. For early strength, the normal concrete is produced to have a water-cement ratio of 42% or below, but the slump of 60 to 80 mm is not controlled using the water-cement ratio but adjusted using an AE agent serving as a water-reducing agent.

If the concrete mixer truck 40 is transported to a construction site, the normal concrete put into the concrete mixer truck 40 suffers from bad pumping due to an additional loss of slump during the transportation. Thus, bubbles generated by a foaming agent, a bubble forming agent or a bubble generator are put into the concrete mixer truck 40. At this time, regarding the amount of bubbles put into the concrete mixer truck 40, 20 to 40% of bubbles, based on the volume of the normal concrete, is put to increase fluidity. Here, a bubble forming agent is put into the bubble generator and then an air pressure is applied thereto by means of a compressor and external water of a certain pressure to produce the bubbles. At this time, it is important that a constant pressure is applied since the amount of produced bubbles changes according to the air pressure. Regarding the bubble generating principle, if a screw air pressure is applied to the bubble forming agent mixed with water, the bubble forming agent generates a surface tension and viscosity to generate spherical bubbles, and the slump of the normal concrete increases due to a ball bearing effect of the bubbles, thereby facilitating easy pumping.

Here, in order to mix 30% of bubbles, based on the volume of the normal concrete, a bubble generator is operated for about 60 seconds per 1 m3 of normal concrete to generate and put 240 L of bubbles.

Figure 10:
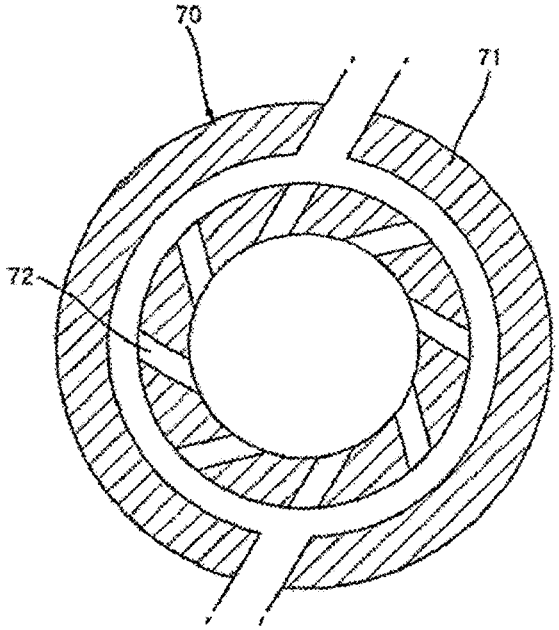
Figure 11:
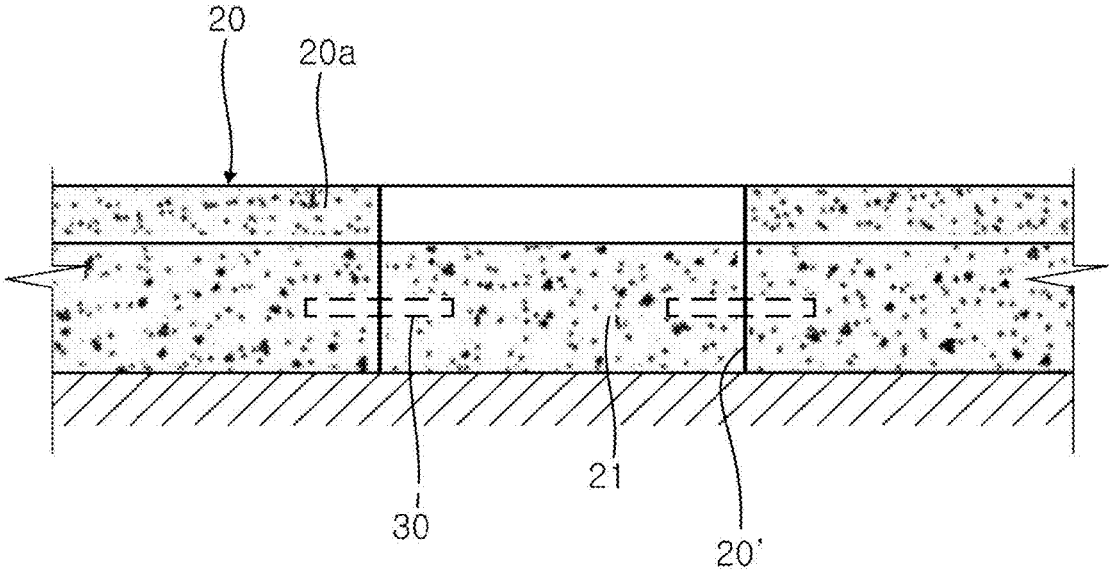
FIG. 11 is a diagram showing a lower layer portion of a concrete pavement, formed at a repair section of a rapid-set blended concrete according to the present disclosure.
Figure 12:
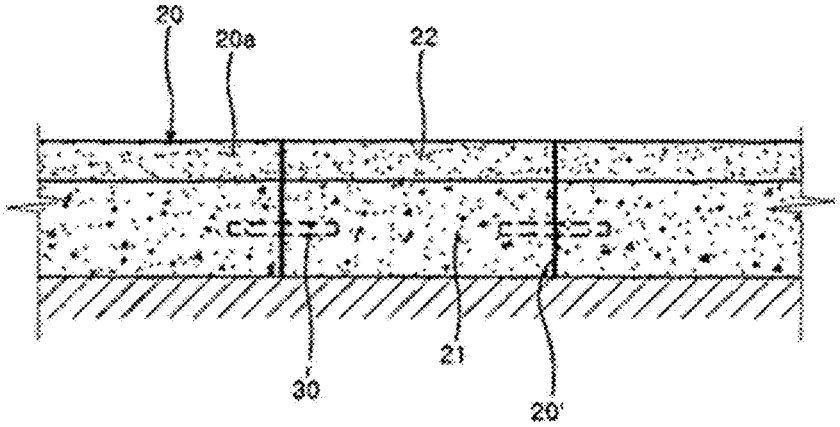
FIGS. 12 and 13 are diagrams showing an upper layer portion of a concrete pavement, formed at a repair section of a high-performance rapid-set blended concrete according to the present disclosure.

In addition, if the bubbles are put into the normal concrete, by means of the ball bearing effect of the bubbles, as shown in FIGS. 10 and 11, a plurality of mixing members 62 mounted to a shaft 61 of the mixing unit 60 uniformly rotate by means of a power of a motor (not shown) to mix the bubbles. Also, a high-early-strength mixture material formed with at least one of alumina-based ultra-rapid-set clinker powder, amorphous alumina-based ultra-rapid-set clinker powder, Hauyne ultra-rapid-set clinker powder, and mixtures thereof is put into the normal concrete mixed with bubbles by the content of 5 to 40 parts by weight, based on 100 parts by weight of cement of the normal concrete, and mixed by means of the mixing member 62 rotating due to the shaft 61 of the mixing unit 60, thereby forming a rapid-set blended concrete in which the bubbles of the normal concrete are mixed with the high-early-strength mixture material.

The rapid-set blended concrete may adjust a curing time of a blended concrete having a compressive strength of 21 MPa according to the amount of high-early-strength mixture material.

Table 1 below show experiment results for an initial setting and a final setting of a mortar normal mix, in which a Hauyne high-early-strength material is substituted by the content of 7%, 14% and 35% in comparison to cement and a water-cement ratio is changed to 38%, 45% and 55%. As shown in Table 1, it may be found that as a substitution ratio of the high-early-strength material becomes higher, the initial setting and the final setting tend to become faster. Also, it may be found that as the water-cement ratio increases, the initial setting and the final setting becomes slower.

Therefore, if early traffic opening is necessary and thus a mixture material of a high-early-strength material should be put, the water-cement ratio should be reduced as low as possible, and the high-early-strength concrete, the ultrahigh-early-strength concrete and the rapid-set blended concrete should be produced with a controlled inclusion to adjust a traffic opening time.

TABLE 1

| | CSA 7% | | CSA 14% | | CSA 35% | |
|---|---|---|---|---|---|---|
| kind | initial setting | final setting | initial setting | final setting | initial setting | final setting |
| W/C 38% | 307 minutes | 558 minutes | 284 minutes | 459 minutes | 151 minutes | 294 minutes |
| W/C 45% | 365 minutes | 563 minutes | 386 minutes | 607 minutes | 143 minutes | 384 minutes |
| W/C 55% | 456 minutes | 670 minutes | 543 minutes | 758 minutes | 200 minutes | 419 minutes |

Here, the initial setting means a state where a cement paste is soft but has no fluidity, and the time at this is called an initial setting time. Also, the final setting means a state where the cement paste looks like being coagulated as time passes, and the time at this is called a final setting time.

In case of the high-early-strength concrete, the initial setting generally appears after 60 minutes, and the concrete mixer truck 40 may be used if a transporting time is not long. However, in case of the ultrahigh-early strength concrete and a rapid-set blended concrete, the initial setting is less than 60 minutes, and thus it is impossible to produce them at the batcher plant 10 and transport to the concrete mixer truck 40. Thus, it is possible not to use a mobile mixer or a small mixer, commonly used at a construction site, which lowers production costs.

Figure 8:
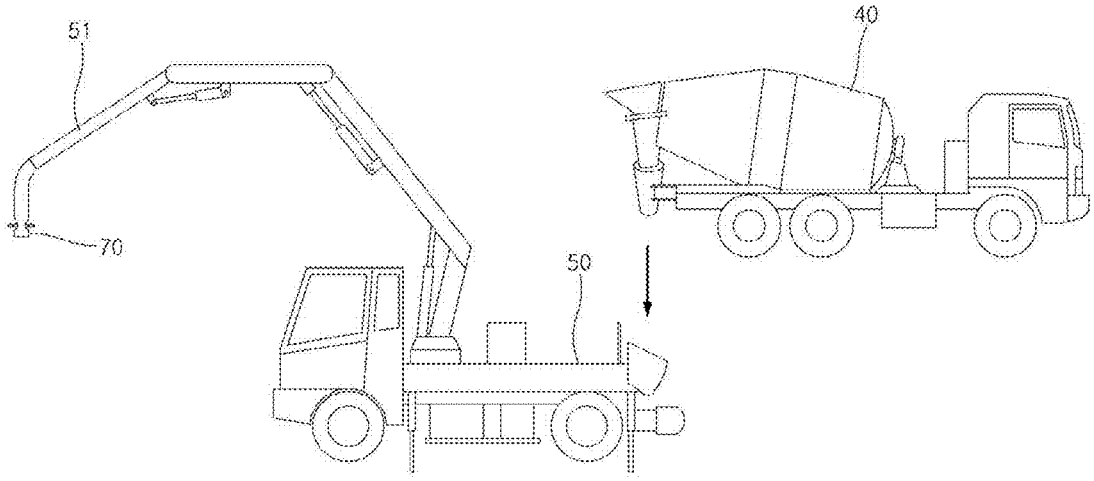
Figure 9:
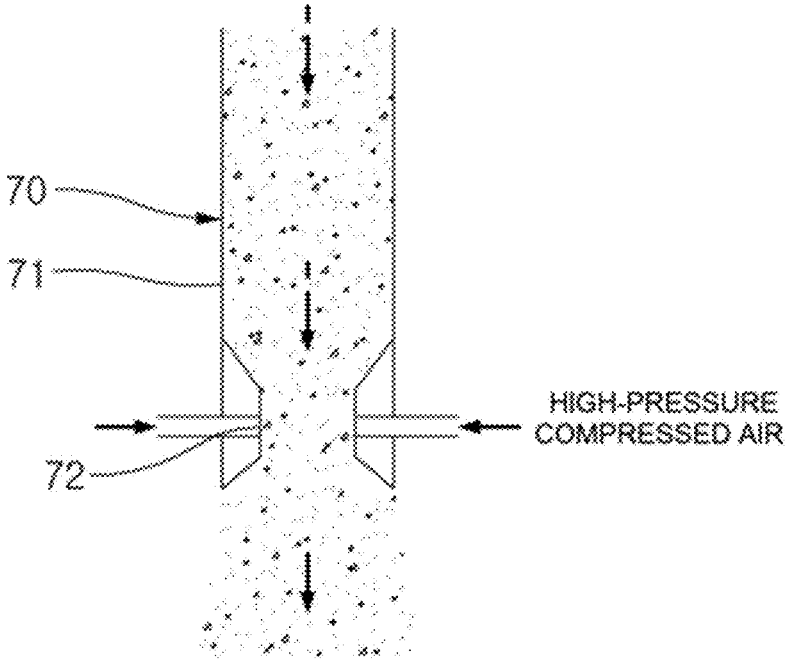
FIGS. 9 to 10 are diagrams for illustrating a process of discharging a blended concrete according to the present disclosure.
Figure 13:
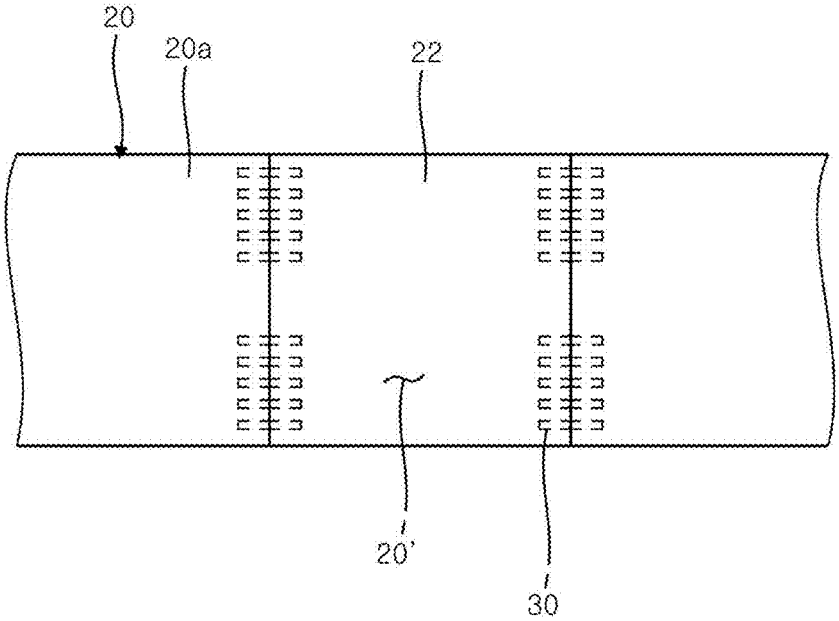
Figure 14:
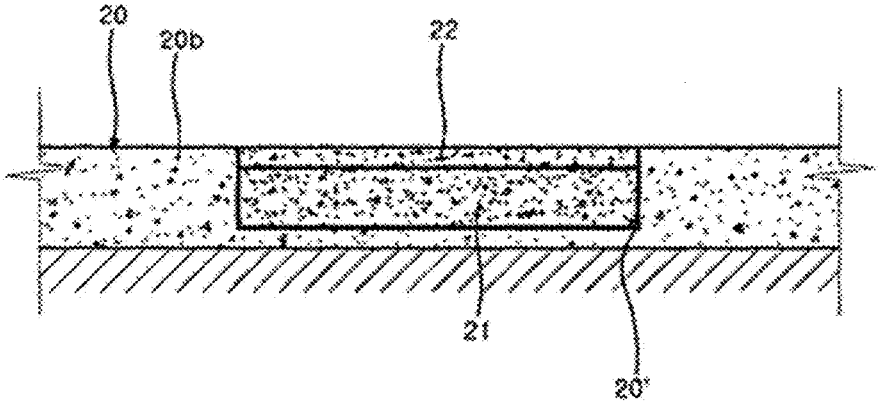
FIG. 14 is a diagram showing a concrete pavement constructed at a repair section of an asphalt pavement according to another embodiment of the present disclosure.
Figure 15:
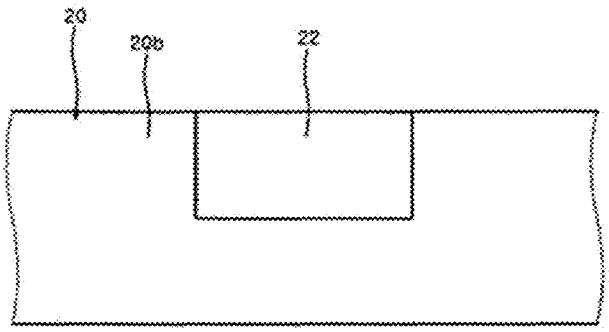
FIG. 15 is a plane view of FIG. 14.

As shown in FIG. 8 and FIG. 9, the rapid-set blended concrete is supplied to a shooting guide body 71 of a shooting guide member 70 mounted to a conveying pipe 51 of the concrete mixer truck 40 or a pump car 50. Also, as shown in FIGS. 13 to 15, the rapid-set blended concrete supplied to the shooting guide member 71 is formed so that its center portion has a smaller diameter than both ends of the shooting guide body 71, and thus, when the rapid-set blended concrete is compressed, a pressure is generated to discharge the rapid-set blended concrete out of the shooting guide body 71.

When the rapid-set blended concrete is discharged out of the shooting guide body 71, a high-pressure compressed air of 5 atmospheres or above is discharged while forming an eddy through an air supply hole 72 formed through an outer circumference of the shooting guide body 71 with a slope in a radial direction. At this time, the compressed air and the rapid-set blended concrete are spread in a spray manner, and when the compressed air and the rapid-set blended concrete are spread in a spray manner, the compressed air and the rapid-set blended concrete collide with each other to be shot to the repair section 20' formed at the concrete-paved road **20*a* or the asphalt-paved road 20*b* while dissipating a large amount of bubbles included in the rapid-set blended concrete, thereby forming a lower layer portion 21 of the paved road 20, as shown in FIGS. 11 to 15**.

Table 2 below show experiment results in which a normal concrete having a compressive strength of 27 MPa ad a target slump of 70 mm is produced at the batcher plant 10 and transported to a construction site by means of the concrete mixer truck 40, then 20%, 27% and 33% of bubbles per unit volume is put thereto, and then the concrete is shot at 9 atmospheres by means of a compressor. When 20% of bubbles are added, the slump, which is 80 mm at the normal concrete, is increased to 250 mm when the bubbles are put. Also, after the shooting, the slump is reduced to 90 mm. If 20% of bubbles are added, water of 6.8 kg/m3 is added, but after final shooting, the slump is reduced, because water molecules are mostly dissipated in the air after the rapid-set blended concrete is being shot. If bubbles are put by the content of 27% and 33%, since an added unit amount is great, after shooting, the final slump is greater than the slump of the normal concrete.

TABLE 2

| amount of put bubbles | | slump (mm) | | | air volume (%) | | |
|---|---|---|---|---|---|---|---|
| amount of bubbles | added unit amount ($kg/m^3$) | normal concrete | after putting bubbles | after shooting | normal concrete | after putting bubbles | after shooting |
| 20% | 6.8 | 80 | 250 | 90 | 7 | 20 | 6 |
| 27% | 9.1 | 70 | 260 | 100 | 5 | 27 | 7 |
| 33% | 18.1 | 70 | 275 | 150 | 5 | 33 | 7 |

The concrete having an increased slump has a good pumping property, and if a high-early-strength mixture material in a powder form is additionally put and mixed thereto, the high-early-strength mixture material may be regularly dispersed.

Therefore, by additionally putting a high-early-strength mixture material having a rapid-setting property to the normal concrete mixed with bubbles, for a high-early-strength concrete, an ultrahigh-early-strength concrete and a rapid-set concrete, to adjust a final slump, the strength may be early realized.

Here, the rapid-set blended concrete may be shot to the repair section 20' formed at the concrete-paved road 20*a* so that the concrete-paved road 20*a* may keep a thickness of 300 mm, for example a thickness of 200 to 250 mm, and the rapid-set blended concrete may also be shot to the repair section 20' formed at the asphalt-paved road 20*b* so that the asphalt-paved road 20*b* may keep a thickness of 200 mm, for example a thickness of 120 to 160 mm.

In addition, a high-performance rapid-set blended concrete is shot to a top surface of the lower layer portion 21 of the paved road 20. The high-performance rapid-set blended concrete is formed by mixing 5 to 40 parts by weight of high-early-strength mixture material, formed by mixing at least one of alumina-based ultra-rapid-set clinker powder, amorphous alumina-based ultra-rapid-set clinker powder, Hauyne ultra-rapid-set clinker powder, and combinations thereof, to the normal concrete including bubbles, based on 100 parts by weight of cement of the normal concrete, and mixing a durable mixture material, formed by mixing at least one of silica fume, metakaolin, fly ash, slag powder, latex, polymer, and mixtures thereof, thereto.

Figure 6:
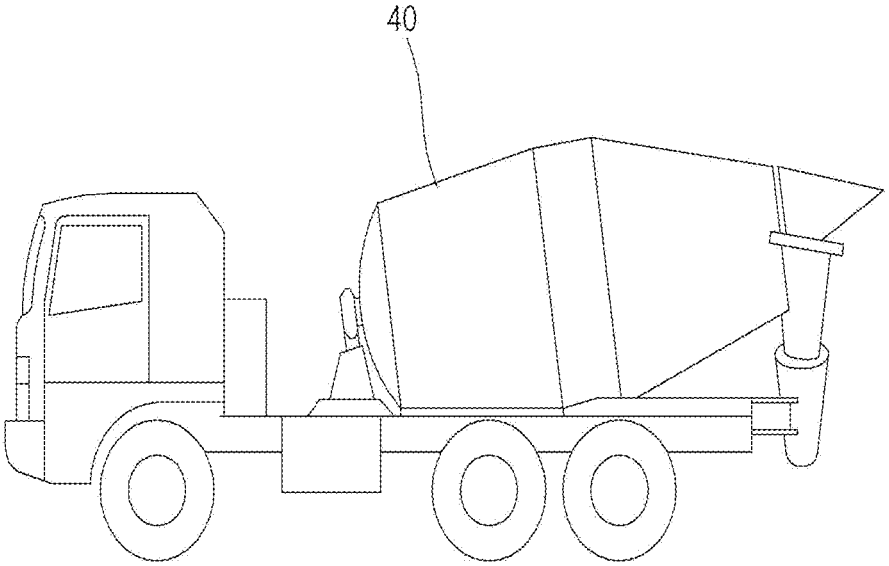
FIGS. 6 to 8 are diagrams showing a mixing unit according to the present disclosure.

At this time, the silica fume and the metakaolin are mixed by 2 to 20 parts by weight, based on 100 parts by weight of cement of the normal concrete, the fly ash and the slag powder are mixed by 3 to 30 parts by weight, based on 100 parts by weight of cement of the normal concrete, and the latex and the polymer are mixed by 1 to 15 parts by weight, based on 100 parts by weight of cement of the normal concrete. Here, as shown in FIGS. 6 and 7, the normal concrete, the bubbles, the high-early-strength mixture material and the durable mixture material are mixed by means of the mixing member 62 rotating due to the shaft 61 of the mixing unit 60 in the concrete mixer truck 40 to form a high-performance rapid-set blended concrete.

As shown in FIG. 8, the high-performance rapid-set blended concrete is supplied to the shooting guide body 71 of the shooting guide member 70 mounted to the conveying pipe 51 of the concrete mixer truck 40 or the pump car 50, and as shown in FIGS. 9 and 10, the high-performance rapid-set blended concrete supplied to the shooting guide body 71 is discharged out of the shooting guide body 71 since the shooting guide body 71 has a central portion with a smaller diameter than both ends thereof and thus it is compressed to generate a pressure.

When the high-performance rapid-set blended concrete is discharged out of the shooting guide body 71, a high-pressure compressed air of 5 atmospheres or above is discharged while forming an eddy through the air supply hole 72 formed through the outer circumference of the shooting guide body 71 with a slope in a radial direction. At this time, the compressed air and the high-performance rapid-set blended concrete are spread in a spray manner, and when the compressed air and the high-performance rapid-set blended concrete are spread in a spray manner, the compressed air and the high-performance rapid-set blended concrete collide with each other to be shot to the top surface of the lower layer portion 21 of the paved road 20 while dissipating a large amount of bubbles included in the high-performance rapid-set blended concrete, thereby forming an upper layer portion 22.

At this time, the high-performance rapid-set blended concrete may be shot to the top surface of the lower layer portion 21 of the concrete-paved road 20*a* with a thickness of 50 to 100 mm, and the high-performance rapid-set blended concrete may be shot to the top surface of the lower layer portion 21 of the asphalt-paved road 20*b* with a thickness of 40 to 80 mm. Since the high-performance rapid-set blended concrete has a rapid-setting property and durability, it is possible to reduce construction time and facilitate easy maintenance, and the upper layer portion 22 may have a smaller thickness than the lower layer portion 21 to reduce construction costs and thus improve economic feasibility.

Table 3 below show experiment results in which a normal concrete having a compressive strength of 27 MPa ad a target slump of 70 mm is produced at the batcher plant 10 and transported to a construction site by means of the concrete mixer truck 40, and then 27% of bubbles per unit volume is put thereto. The slump is 80 mm at the normal concrete, but when the bubbles are put, the slump is increased to 260 mm. Also, after 7% of silica fume in a slurry form in comparison to cement is added, the slump is increased to 270 mm. In addition, when 5% of latex solution in comparison to cement is added, the slump increases due to a surfactant of latex but decreases due to the air volume serving as a deforming agent. Also, when 7% of Hauyne high-early-strength material in a powder form in comparison to the weight of cement is added, the slump decreases to 180 mm. In addition, it may be found that concrete having a slump of 80 mm is obtained after shooting.

In addition, the air volume is 5% at the normal concrete, but it may be found that the air volume increases to 27% after the bubbles are put, the air volume decreases to 21% after silica fume powder is added, and the air volume decrease to 5% after shooting.

If silica fume, latex and high-early-strength material powder are put in order into the normal concrete having an increased slump by putting 27% of bubbles in volume and mixed again, these materials may be regularly dispersed. Here, for regular dispersion of the high-early-strength material powder, the above materials may be put in the order of silica fume, latex and high-early-strength material powder as above.

TABLE 3

| item | normal concrete | after putting 27% of bubbles | after putting 7% of silica fume | after putting 5% of latex | after putting 7% of high-early-strength material | after shooting |
|---|---|---|---|---|---|---|
| slump (mm) | 70 | 260 | 270 | 285 | 180 | 80 |
| air volume (%) | 5 | 27 | 26 | 21 | 21 | 5 |

Figure 16:
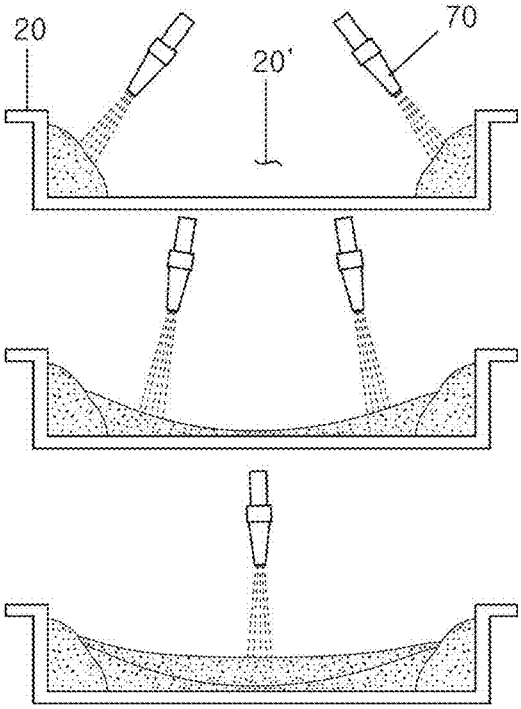
FIG. 16 is a diagram for illustrating a process of shooting a rapid-set blended concrete and a high-performance rapid-set blended concrete according to the present disclosure.

As shown in FIG. 16, the rapid-set blended concrete and the high-performance rapid-set blended concrete shot by means of the shooting guide member 70 may be shot to corners at both sides to fill the corners and then shot to fill inwards. If the concrete is filled from the inside, rebounds may be stacked at the corners of both sides, which may lead to inferior concrete.

In addition, if shooting is performed under a regular pressure, it is possible to produce dense and compact concrete, which does not need a separate hardening process, and thus the construction process may be reduced.

Figure 17:
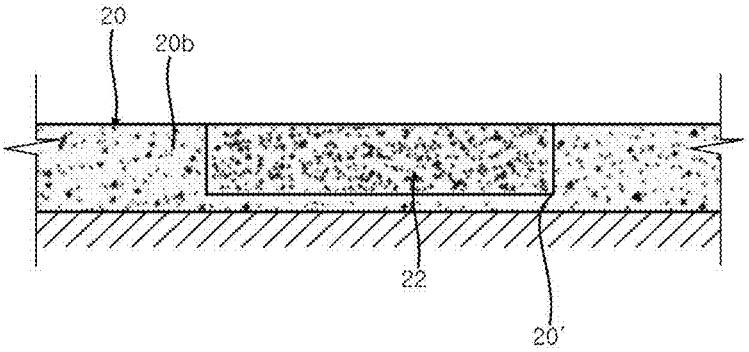
FIG. 17 is a diagram showing a concrete pavement constructed at a repair section of an asphalt pavement according to another embodiment of the present disclosure.

Here, even though it has been described that the lower layer portion 21 and the upper layer portion 22 are formed at the repair section 20' of the asphalt-paved road 20*b*, a high-performance rapid-set blended concrete may also be shot to the repair section 20' of the asphalt-paved road 20*b* to pave the upper layer portion 22 in a single layer, as shown in FIG. 17.

The top surface of the upper layer portion 22 of the concrete-paved road 20*a*, formed as above, is surface-finished to ensure flatness, and for this, a flattening device suitable for a skill level of workers and a construction size is selected to ensure reliable construction and economic feasibility. Also, if the upper layer portion 22 is completely surface-finished, a tining process is instantly performed using a texturing machine or manpower, then a film curing agent is scattered to suppress rapid moisture evaporation, a wet curing blanket and vinyl are put to perform curing for 3 to 4 hours, and then the vinyl and the curing blanket are removed, thereby completely repairing the repair section 20'.

In addition, a surface-finishing work is performed to ensure flatness of the top surface of the upper layer portion 22 of the asphalt-paved road 20*b*, formed as above. For this, a flattening device suitable for a skill level of workers and a construction size is selected to ensure reliable construction and economic feasibility. Also, if a curing agent is scattered to the upper layer portion 32 of the surface-finished concrete pavement 30 and the top surface of the single-layered concrete pavement 30 and cured, joints are formed at regular intervals to ¼ depth of the thickness of the repair section by using a diamond saw, thereby completely repairing the repair section 20'.

In the present disclosure, the embodiment is just an example, and the present disclosure is not limited thereto. Any feature whose construction and effect are identical to those defined in the claims of the present disclosure should be regarded as falling within the scope of the present disclosure.

The invention claimed is:

1. A method for repairing a paved road, comprising:

forming a repair section by marking and cutting a repair boundary to accommodate a damaged part of a paved road;

producing a normal concrete having a compressive strength of 21 to 30 MPa by mixing water, cement and aggregate at a predetermined ratio and transporting the normal concrete to a construction site;

putting 20 to 40% of bubbles, based on the volume of the normal concrete, together with a high-early-strength mixture material into the normal concrete and then mixing the same by means of a mixing unit to form a rapid-set blended concrete;

shooting the rapid-set blended concrete to the repair section by means of a shooting guide member to form a lower layer portion of the paved road while dissipating bubbles included in the rapid-set blended concrete;

putting 20 to 40% of bubbles, based on the volume of the normal concrete, together with a high-early-strength mixture material and a durable mixture material into the normal concrete and then mixing the same by means of the mixing unit to form a high-performance rapid-set blended concrete;

shooting the high-performance rapid-set blended concrete to a top surface of the lower layer portion by means of the shooting guide member to form an upper layer portion of the paved road while dissipating bubbles included in the high-performance rapid-set blended concrete; and surface-finishing and curing the paved road so that a top surface of the upper layer portion keeps horizontal to a top surface of the paved road, wherein the shooting guide member includes:

a shooting guide body having a hollow formed therethrough so that the normal concrete, the high-performance rapid-set concrete and the rapid-set concrete are introduced therein, compressed and discharged, the shooting guide body being formed so that a central portion thereof has a smaller diameter than an inlet and an outlet thereof at which each concrete is introduced and discharged; and an air supply hole formed through the shooting guide member to supply a high-pressure air of 5 atmospheres or above so as to reduce an air volume while dissipating bubbles included in each concrete introduced into the shooting guide body.

2. A method for repairing a paved road, comprising:

forming a repair section by marking and cutting a repair boundary to accommodate a damaged part of a paved road;

producing a normal concrete having a compressive strength of 21 to 30 MPa by mixing water, cement and aggregate at a predetermined ratio and transporting the normal concrete to a construction site;

putting 20 to 40% of bubbles, based on the volume of the normal concrete, together with a high-early-strength mixture material and a durable mixture material into the normal concrete and then mixing the same by means of a mixing unit to form a high-performance rapid-set blended concrete;

shooting the high-performance rapid-set blended concrete to the repair section by means of a shooting guide member to form a paved road while dissipating bubbles included in the high-performance rapid-set blended concrete; and surface-finishing and curing the paved road so that a top surface of an upper layer portion keeps horizontal to a top surface of the paved road, wherein the shooting guide member includes:

a shooting guide body having a hollow formed therethrough so that the normal concrete, the high-performance rapid-set concrete and the rapid-set concrete are introduced therein, compressed and discharged, the shooting guide body being formed so that a central portion thereof has a smaller diameter than an inlet and an outlet thereof at which each concrete is introduced and discharged; and an air supply hole formed through the shooting guide member to supply a high-pressure air of 5 atmospheres or above so as to reduce an air volume while dissipating bubbles included in each concrete introduced into the shooting guide body.

3. The method for repairing a paved road of claim 1, wherein when the repair section is formed at a concrete-paved road, the method further comprises:

forming a hole in an existing paved road and installing a reinforcing member therein to enhance a load transmission effect of the repair boundary which is marked to accommodate a damaged part.

4. The method for repairing a paved road of claim 1, wherein when the repair section is formed at an asphalt-paved road, the method further comprises:

cutting and removing the repair boundary, which is marked to accommodate a damaged part, to a depth of 130 to 200 mm.

5. The method for repairing a paved road of claim 1, wherein the high-early-strength mixture material is formed with at least one selected from the group consisting of alumina-based ultra-rapid-set clinker powder, amorphous alumina-based ultra-rapid-set clinker powder, Hauyne ultra-rapid-set clinker powder, and mixtures thereof.

6. The method for repairing a paved road of claim 5, wherein the high-early-strength mixture material is mixed by the content of 5 to 40 parts by weight, based on 100 parts by weight of cement of the normal concrete.

7. The method for repairing a paved road of claim 1, wherein the durable mixture material is formed with at least one selected from the group consisting of silica fume, metakaolin, fly ash, slag powder, latex, polymer, and mixtures thereof.

8. The method for repairing a paved road of claim 7, wherein the silica fume and the metakaolin are mixed by 2 to 20 parts by weight, based on 100 parts by weight of cement of the normal concrete.

9. The method for repairing a paved road of claim 7, wherein the fly ash and the slag powder are mixed by 3 to 30 parts by weight, based on 100 parts by weight of cement of the normal concrete.

10. The method for repairing a paved road of claim 7, wherein the latex and the polymer are mixed by 1 to 15 parts by weight, based on 100 parts by weight of cement of the normal concrete.

11. The method for repairing a paved road of claim 1, wherein the high-performance rapid-set blended concrete is mixed with at least one coloring material selected from the group consisting of iron oxide, carbon black, and mixtures thereof.

12. The method for repairing a paved road of claim 11, wherein the coloring material is included by the content of 1 to 8 parts by weight, based on 100 parts by weight of cement of the normal concrete.

13. The method for repairing a paved road of claim 1, wherein the mixing unit includes:

a shaft configured to rotate by means of a power of a motor in a concrete mixer truck to which the normal concrete is put; and a mixing member formed at the shaft to have at least one stage in a radial direction to mix the normal concrete with bubbles and a mixture material while rotating in a rotation direction of the shaft.

14. The method for repairing a paved road of claim 1, wherein the air supply hole is formed with a slope in a radial direction at an outer circumference of the shooting guide body.

15. The method for repairing a paved road of claim 1, further comprising:

forming joints at a top surface of the paved road, which is surface-finished to keep a horizontal state, at regular intervals.

16. The method for repairing a paved road of claim 2, wherein when the repair section is formed at a concrete-paved road, the method further comprises:

forming a hole in an existing paved road and installing a reinforcing member therein to enhance a load transmission effect of the repair boundary which is marked to accommodate a damaged part.

17. The method for repairing a paved road of claim 2, wherein when the repair section is formed at an asphalt-paved road, the method further comprises:

cutting and removing the repair boundary, which is marked to accommodate a damaged part, to a depth of 130 to 200 mm.

18. The method for repairing a paved road of claim 2, wherein the high-early-strength mixture material is formed with at least one selected from the group consisting of alumina-based ultra-rapid-set clinker powder, amorphous alumina-based ultra-rapid-set clinker powder, Hauyne ultra-rapid-set clinker powder, and mixtures thereof.

19. The method for repairing a paved road of claim 2, wherein the durable mixture material is formed with at least one selected from the group consisting of silica fume, metakaolin, fly ash, slag powder, latex, polymer, and mixtures thereof.

* * * * *